US006827656B1

(12) United States Patent
Hoeflich et al.

(10) Patent No.: US 6,827,656 B1
(45) Date of Patent: Dec. 7, 2004

(54) HIGHER OVERALL FLEX GOLF SHAFT

(75) Inventors: John B. Hoeflich, Lafayette, CO (US); Robin D. Arthur, San Diego, CA (US)

(73) Assignee: HD Golf Development, Inc., Denver, CO (US)

( * ) Notice: Subject to any disclaimer, the term of this patent is extended or adjusted under 35 U.S.C. 154(b) by 869 days.

(21) Appl. No.: 08/787,745

(22) Filed: Jan. 24, 1997

(51) Int. Cl.[7] ..... A63B 53/10
(52) U.S. Cl. ..... 473/319
(58) Field of Search ..... 473/316, 319, 473/320, 321

(56) References Cited

U.S. PATENT DOCUMENTS 3,848,480 A * 11/1974 Oseroff ..... 473/301
4,399,993 A * 8/1983 Melin ..... 473/537
4,595,204 A * 6/1986 Patterson ..... 473/227
4,682,504 A * 7/1987 Kobayashi ..... 73/854
4,725,060 A * 2/1988 Iwanaga ..... 473/319
5,018,735 A * 5/1991 Meredith et al. ..... 473/318
5,088,735 A * 2/1992 Shigetoh ..... 473/320
5,156,396 A * 10/1992 Akatsuka ..... 473/319
5,308,062 A * 5/1994 Hogan ..... 473/319
5,437,450 A * 8/1995 Akatsuka ..... 473/319
5,439,219 A * 8/1995 Vincent ..... 473/319
5,571,051 A * 11/1996 Huang ..... 473/302
5,575,473 A * 11/1996 Turner ..... 473/298

* cited by examiner

*Primary Examiner*—Stephen Blau
(74) *Attorney, Agent, or Firm*—Fay, Sharpe, Fagan, Minnich & McKee, LLP

(57) ABSTRACT

A composite golf club shaft is constructed having a reduced butt diameter of 0.400 to 0.560 inches in diameter. The shaft tapers without intentional discontinuities from the reduced-diameter butt section to a cylindrical tip portion having a standard tip diameter adapted to be attached to the hosel of a club head. By reducing the diameter of the butt portion of the shaft while maintaining the shaft free of substantial discontinuities, lead-lag flexure is increased uniformly, thereby improving the controllability of the shaft, and without inducing the artificial bending modes found in bubble shafts and other shaft configurations having intentional discontinuities.

13 Claims, 10 Drawing Sheets

CANILEVER BEAM
CASE 1:
LENGTH = 45"
OD/STD. = .620"
OD/SMALL = .540"
TIP LOAD = 6 lb.

SIMPLY SUPPORTED BEAM
CASE 1:
LENGTH = 45"
OD/STD. = .620"
OD/SMALL = .540"
MOMENT, @BUTT = 1 ft. lb.
MOMENT, @TIP = 1 ft. lb.

HIGHER OVERALL FLEX GOLF SHAFT

BACKGROUND OF THE INVENTION

The present invention relates to golf clubs, more particularly to composite golf club shafts.

In hitting a golf ball with a golf club, deflection in the golf club shaft may adversely affect the angle at which the face of the golf club head strikes the golf ball. As the club is accelerated during the stroke, the face of the club is deflected from its static position by four principal forces acting on the club head: (1) the gross body acceleration of the club head in the plane of the swing ("lead-lag"); (2) a transverse moment acting in a plane normal to the plane of the swing generated by the centrifugal force of the swing acting on the center of mass of the club head, which tends to rotate the club head toe down ("toe down"); (3) a second centrifugal force acting on the center of mass of the club head, which tends to rotate the club face up ("loft increase"); and (4) a torsional moment caused along the shaft caused by the acceleration of the club head, which tends to open the face of the club head and increase slice.

Each of these forces are dynamically resisted by the elastic material properties of the shaft itself, which results in a shaft that is vibrating in a number of complex modes at the instant the golf ball is hit. These complex modes of vibration are especially disadvantageous if the deflection of the golf club shaft is inconsistent from stroke to stroke. On the other hand, not only is it impossible to completely eliminate the vibration modes from a golf shaft, it is quite necessary that the golf club shaft deflect during the stroke, for up to 10% of the energy delivered to the golf ball is energy stored in the bending of the shaft during the beginning of the stroke that is released during the time the ball is in contact with the club.

The prior art has addressed the need for shaft having a desirable lead-lag flexibility with a greater degree of control over unwanted vibration modes affecting club head contact angles. Virtually all prior art attempts, however, have concentrated on creating a discontinuity between the lower portion of the shaft and the grips. For example, U.S. Pat. No. 4,319,750 to Roy discloses a shaft which comprises a standard profile shaft having a discontinuity between the lower shaft and the butt portion intentionally introduced by mismatching the elasticity of the materials making up the two sections of the shaft. Similarly U.S. Pat. No. 5,439,219 to Vincent discloses a so-called "Bubble" shaft comprising a discontinuous flexible zone interposed between a rigid butt section and the remainder of the shaft. U.S. Pat. No. 4,330,126 to Rumble discloses a metal golf club shaft having a discontinuity between a narrow but section having an outside diameter of 0.590 inches immediately adjacent a wider shaft section having a diameter of 0.620 inches immediately below the butt section. Bubble shafts and other shafts with intentional discontinuities are found disagreeable by many players, however, because such pronounced discontinuities in a golf club shaft produce an exaggerated and artificial feedback to the player's hands, thereby reducing the subjective quality of the "feel" of the shaft. Such intentional discontinuities also introduce additional degrees of freedom of vibration, in effect, introducing hinges into an already complex vibrational system. The additional hinges cause the shafts to vibrate in unusual and more complex modes than do shaft without such intentional discontinuities.

What is needed then, is a composite shaft with a high degree of flexure, without the artificial feel caused by pronounced discontinuities, and with a high degree of control over the amplitude of the unwanted vibration modes of the club head.

SUMMARY OF THE INVENTION

According to the present invention a composite golf club shaft is constructed having a reduced butt diameter of 0.400 to 0.560 inches in diameter, preferably from 0.450 to 0.550 and most preferably from 0.520 to 0.540 inches in diameter. In a "standard taper" embodiment of the present invention, the shaft tapers without intentional discontinuities from the reduced-diameter butt section to a cylindrical tip portion having a standard tip diameter adapted to be attached to the hosel of a club head. In a standard "parallel-taper-parallel" embodiment of the present invention, the reduced-diameter cylindrical butt portion of the shaft continues without intentional discontinuity until it meets the tapered portion of the shaft, which in turn tapers until it meets the cylindrical tip portion of the shaft. By reducing the diameter of the butt portion of the shaft while maintaining the shaft free of substantial discontinuities, not only is the lead-lag flexure increased, with concomitant increase in distance, but the subjective feel of the club is improved with a concomitant increase in the player's ability to control the club.

BRIEF DESCRIPTION OF THE DRAWING

The present invention will be better understood from a reading of the following detailed description, taken in conjunction with the accompanying drawing Figs. in which like references designate like elements and, in which.

DETAILED DESCRIPTION

Figure 1:
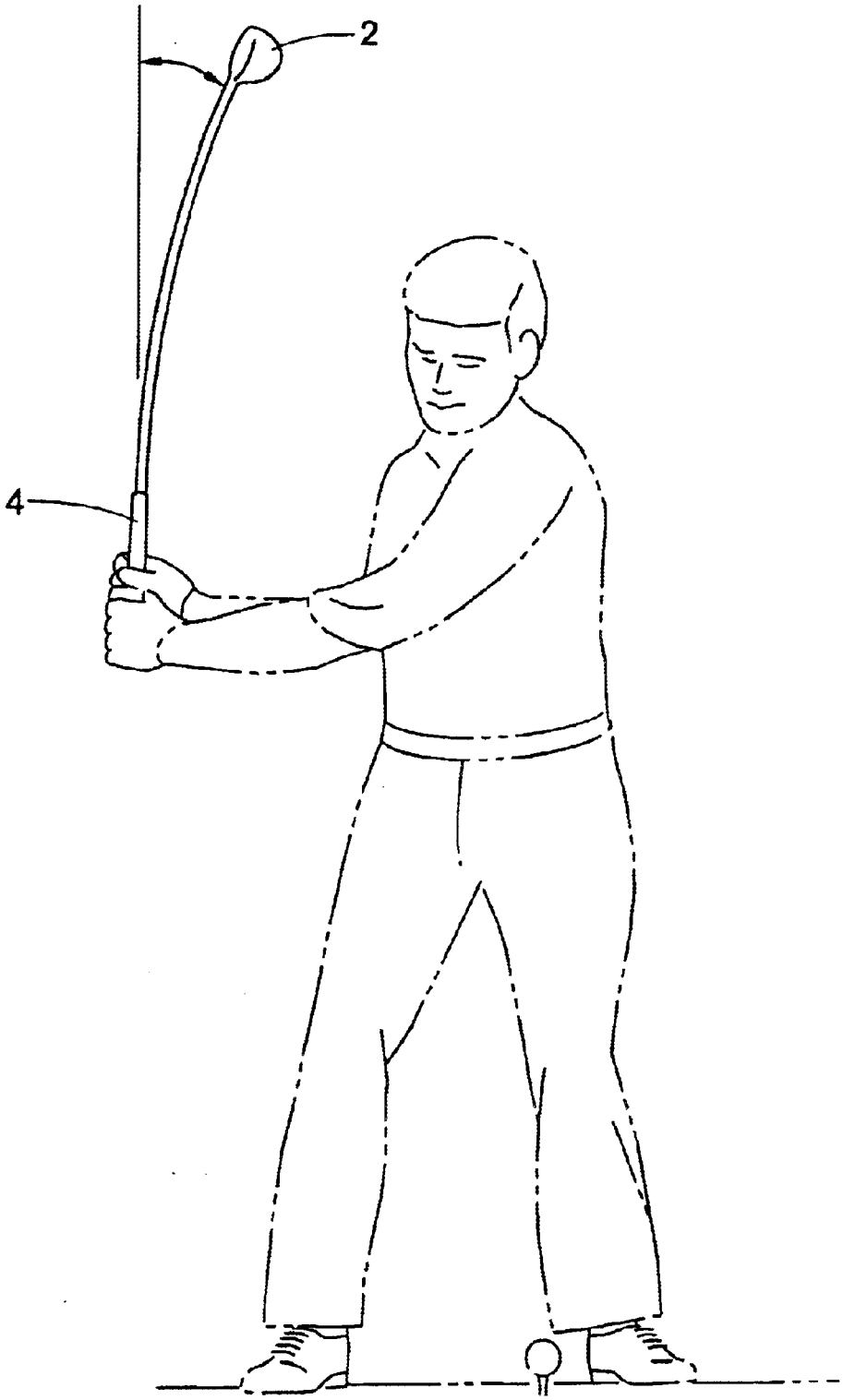
FIG. 1 illustrates a first bending mode of a golf shaft in the plane of the swing.
Figure 2A:
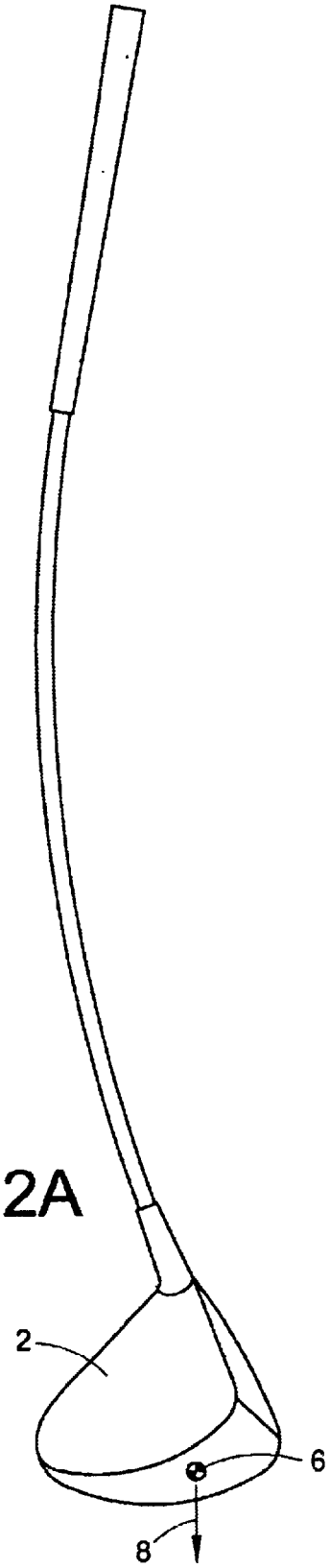
FIG. 2A illustrates a first bending mode of a golf shaft transverse to the plane of the swing.
Figure 2B:
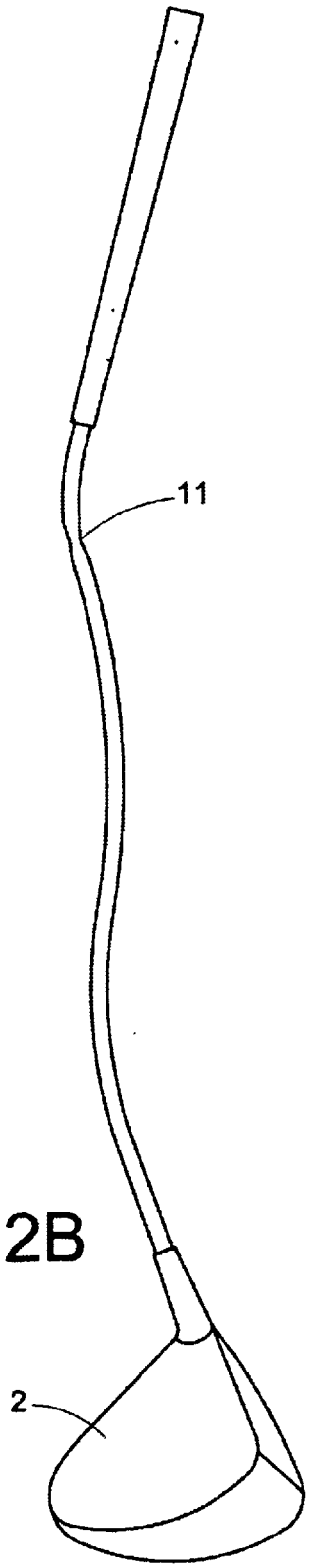
FIG. 2B illustrates a higher order bending mode of a golf shaft transverse to the plane of the swing.
Figure 3:
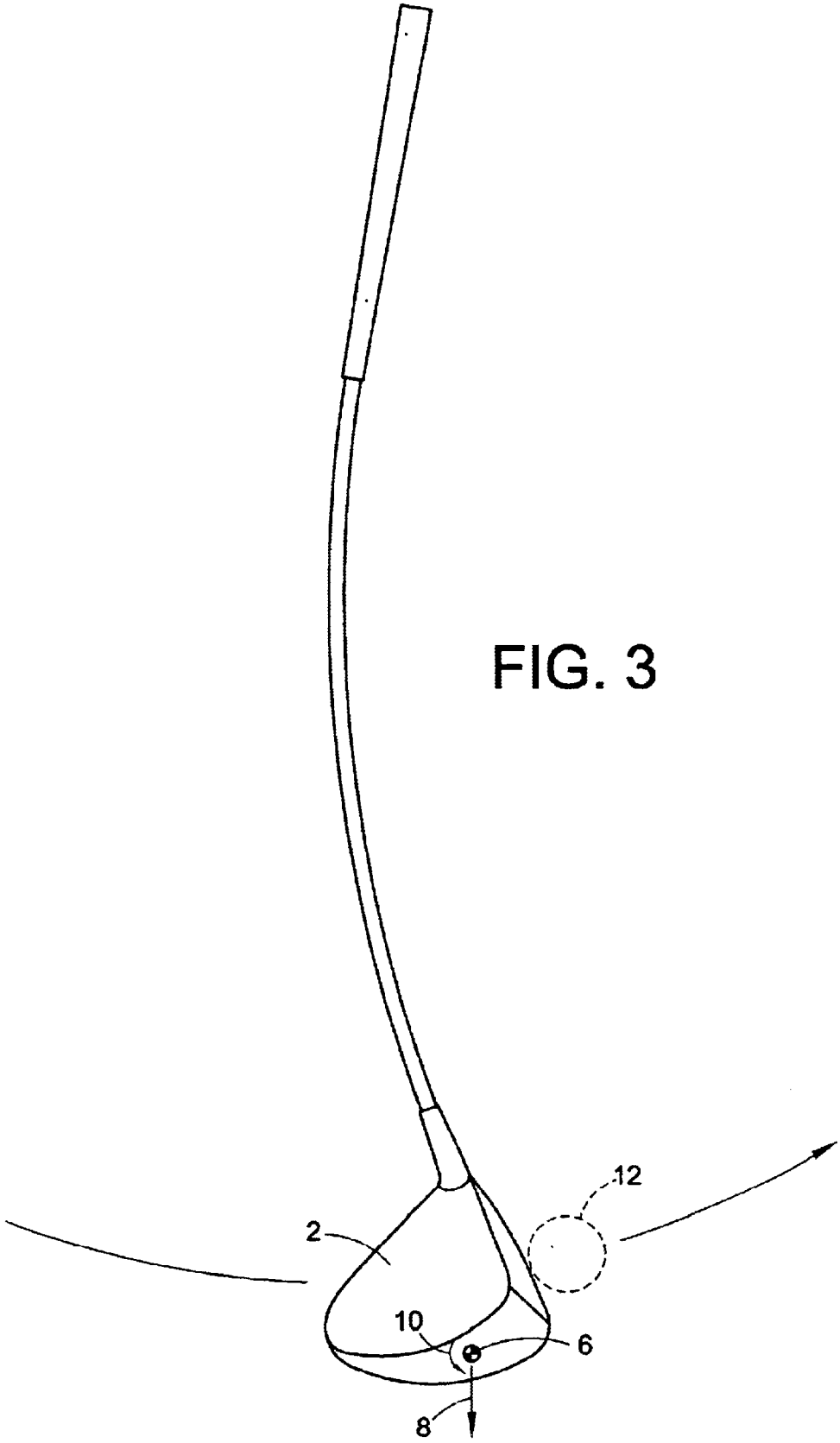
FIG. 3 illustrates an additional bending mode of a golf shaft in the plane of the swing.
Figure 4A:
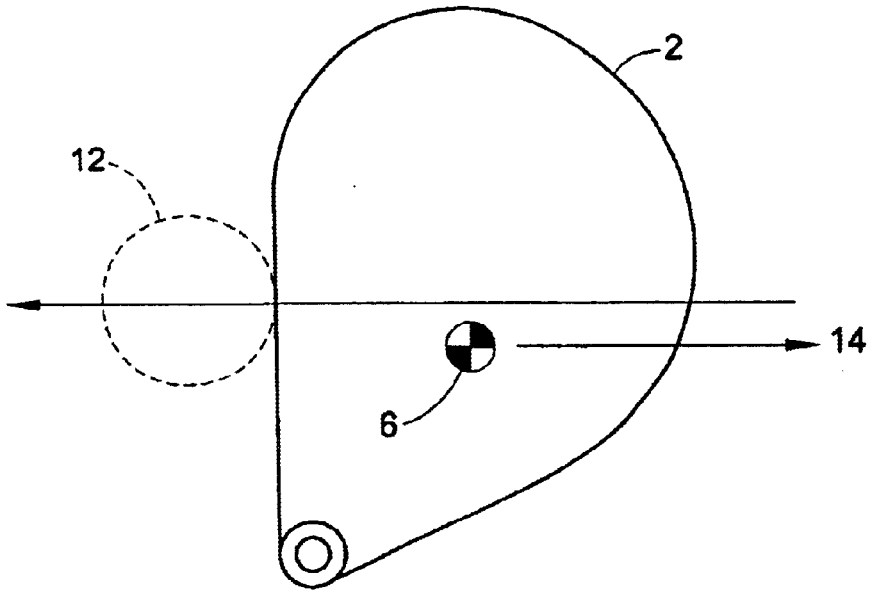
FIGS. 4A and 4B illustrate a torsional bending mode of a golf shaft.
Figure 4B:
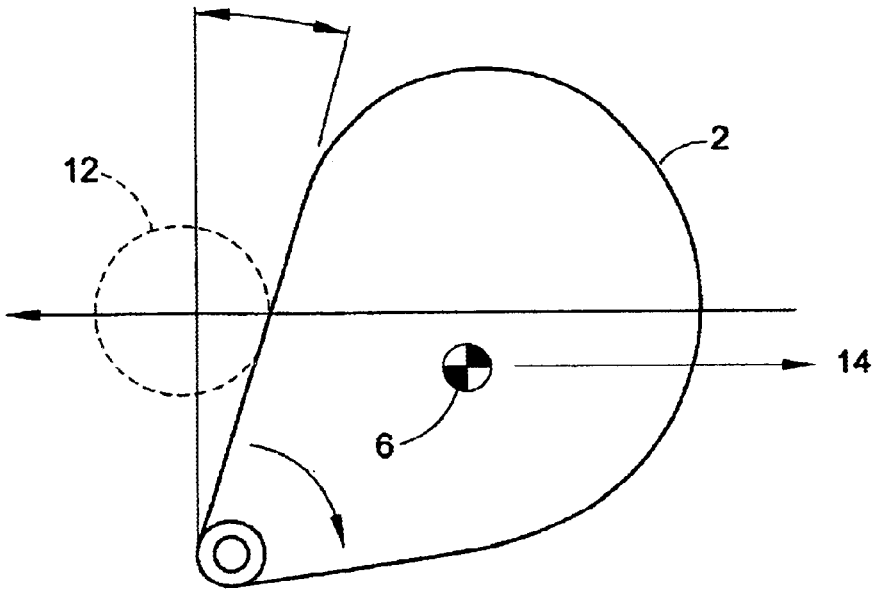

As indicated above, in hitting a golf ball with a golf club, deflection in the golf club shaft may adversely affect the angle at which the face of the golf club head strikes the golf ball. As the club is accelerated during the stroke, the face of the club is deflected from its static angle by four principal forces acting on the club head. With reference to FIG. 1, at the beginning of the stroke, the gross body acceleration of the club head 2 in the plane of the swing lags the gross body acceleration of the butt portion 4, causing the shaft to bend in the characteristic "lead-lag" principal bending mode in the plane of the swing. Lead-lag bending is a critical feature of golf shaft design, for a substantial portion of the energy delivered to the golf ball at impact is energy stored in the form of lead-lag bending that is released as the shaft straightens during the period of time the club is in contact with the golf ball. With reference to FIG. 2, a second important force acting on a club head having a center of mass 6 is the centrifugal force 8 acting on the golf club head 2 as the golfer swings the club head through an arc at velocities approaching 80 miles per hour or more. Particularly the force 8 produces a moment, which tends to rotate the club head 2 into a toe-down position. With reference to FIG. 3, the same force 8 acting on the club head 2 also produces a moment 10, which tends to rotate the club head in the plane of the swing in a counterclockwise direction (when viewed from a position opposite the golfer), thereby increasing the effective loft angle of the club head at impact with golf ball 12. Finally, as shown in FIG. 4, the gross body acceleration of the club head produces a force 14 acting on the center of mass 6 of the club head produces a longitudinal moment that tends to open the face of the golf club head 2 as the club strikes the golf ball 12, thereby increasing the slice at impact. Although each of the above forces and their effect on the club head at impact are described above as if they were steady state forces and deflections, in reality each of the above forces are dynamic during the stroke, and each is resisted by the elastic properties of the club itself to produce complex vibration modes throughout the shaft. Accordingly, static compensation for any of the above forces will not yield predictable results. Moreover, as is evident from the foregoing discussion, a change in design or materials intended to improve one characteristic often has untoward deleterious side effects on one or more other important characteristics of the shaft.

Historically, the bending profile of a golf shaft has been described in terms of its flex point and kick point. The flex point of a shaft was determined experimentally by providing a cantilever support for the shaft and suspending a weight at the opposite end. The kick point was determined experimentally by compressing the shaft axially a fixed distance to induce a first buckling mode in the shaft and determining the location of the apex of the eccentricity. The location of the flex point or kick point was meant to illustrate the point about which the golf club shaft would bend during the golf swing and further to describe the resultant trajectory of the golf ball in flight. For a given degree of flexure, a low flex/bend point (i.e. near the club head) generally indicated a high loft angle and high ball flight, whereas a high flex point (i.e. near the butt) generally indicated a low loft and low trajectory.

Recent studies indicate, however, that traditional methods of measuring flex point and kick point and attempting to correlate these points to a predicted trajectory are extremely limited. A recent study conducted by a prominent equipment distributor on over 800 different composite and steel shafts discovered that the kick/flex points of all shafts differed by only about ½ inch between shafts of similar construction, and only about 1 inch between all composite and steel shafts evaluated. In short, over 800 shafts, when subjected to a series of static tests, resulting in almost identical bend profiles. Prior art attempts to control the location of the flex point, such as the "bubble" shafts of U.S. Pat. No. 5,439,219, while succeeding to some degree in moving the flex/kick point desirably closer to the butt portion, fail to provide for any substantial degree of flexure in the butt portion. Moreover, as illustrated in FIG. 2B, introduction of an intentional discontinuity 11, in effect a hinge in the shaft, produces additional bending degree of freedom in the shaft, which causes more complex bending modes in the shaft, thus leading to a loss of controllability.

Figure 5B:
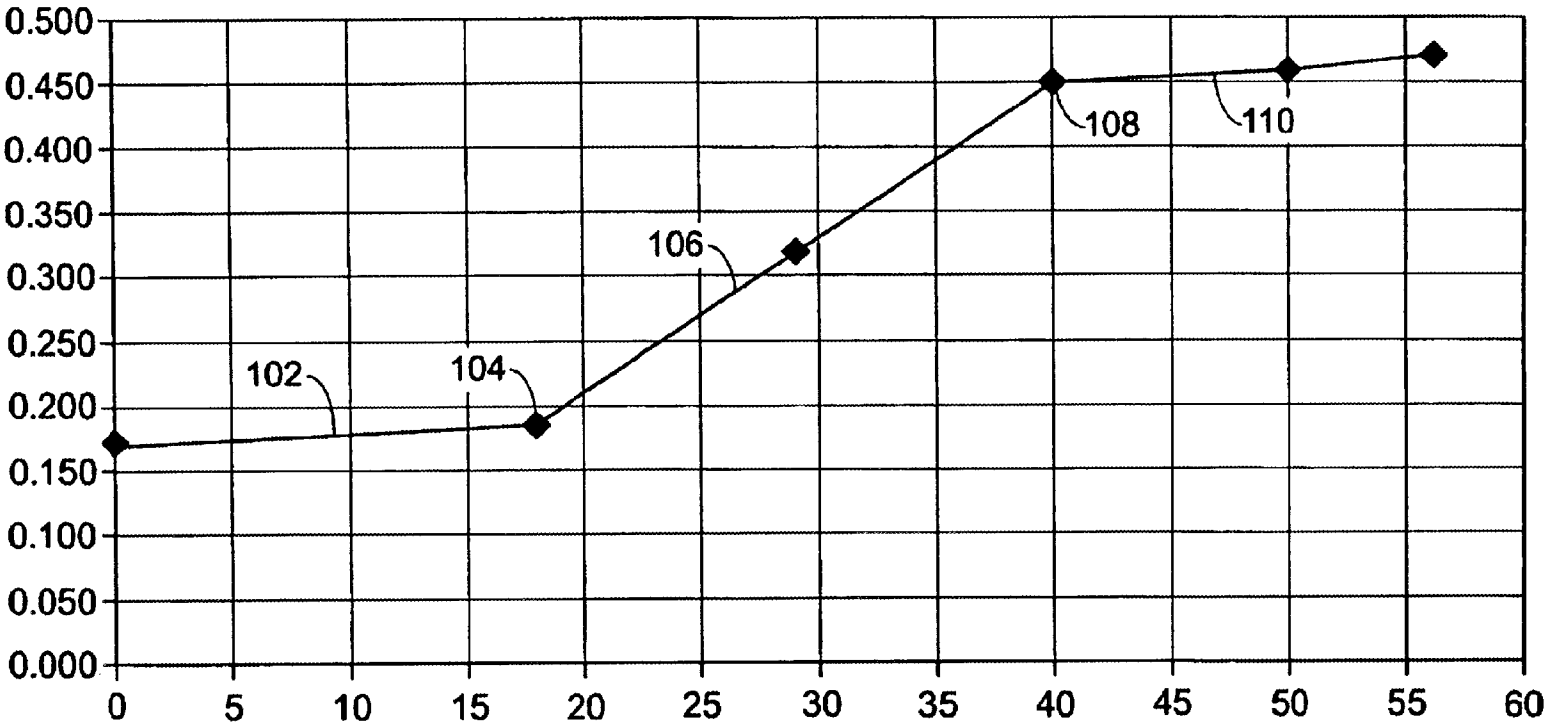
FIGS. 5A and 5B illustrate a mandrel for constructing a golf shaft in accordance with principles of the present invention.
Figure 5A:
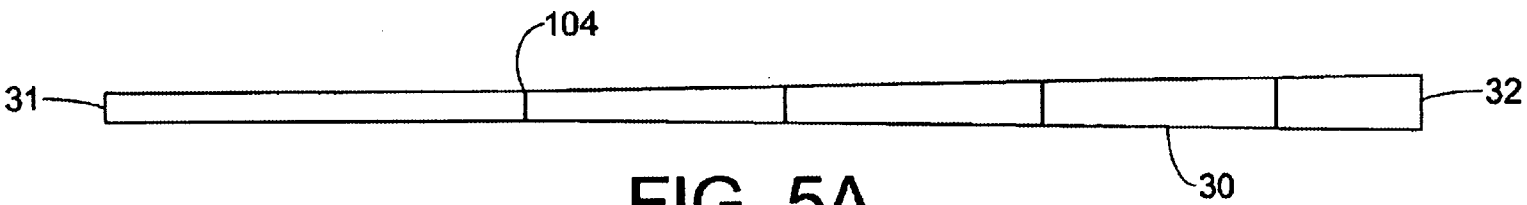

A tapered composite shaft incorporating features of the present invention is composed of a series of sheets or flags of composite material laid-up on a mandrel 30 defining the inside diameter of the shaft as shown in FIG. 5A. The mandrel 30 includes a tip end 31 and a butt end 32. As shown more clearly in FIG. 5B, mandrel 30 comprises a shallow taper 102 from the tip end 31 to an intermediate point 104. A steeper taper 106 proceeds from intermediate point 104 to the lowermost end 108 of butt portion 110. In the illustrative embodiment of FIG. 5B, the diameter of mandrel 30 at the butt portion 110 is between 0.450 inches and 0.460 inches. Accordingly, a shaft constructed on mandrel 30 having a butt diameter of the preferred 0.540 outside diameter would necessarily include a wall thickness of from 0.040 to 0.045 inches.

Figure 7B:
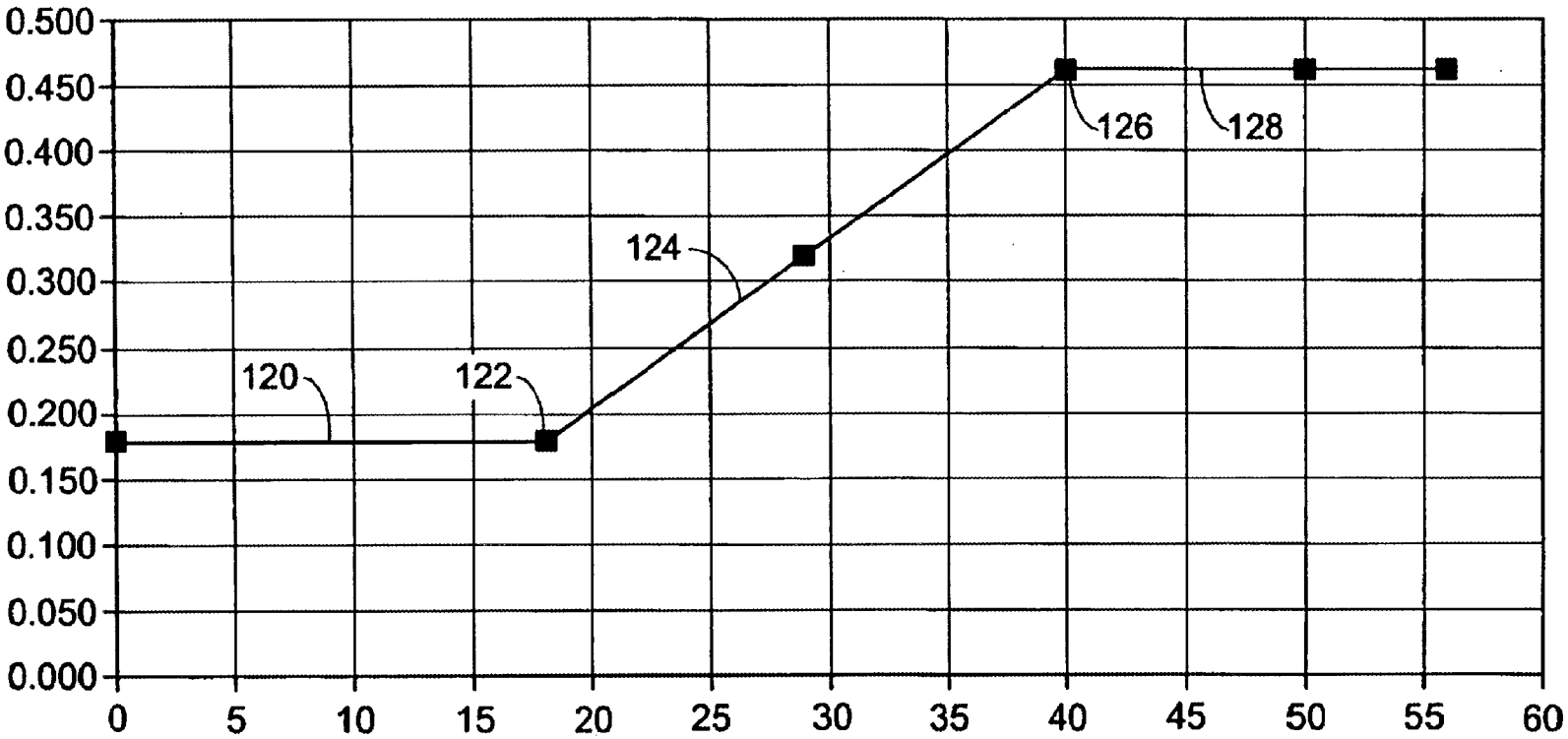
FIGS. 7A and 7B illustrate a mandrel for constructing a golf shaft in accordance with principles of the present invention.
Figure 7A:
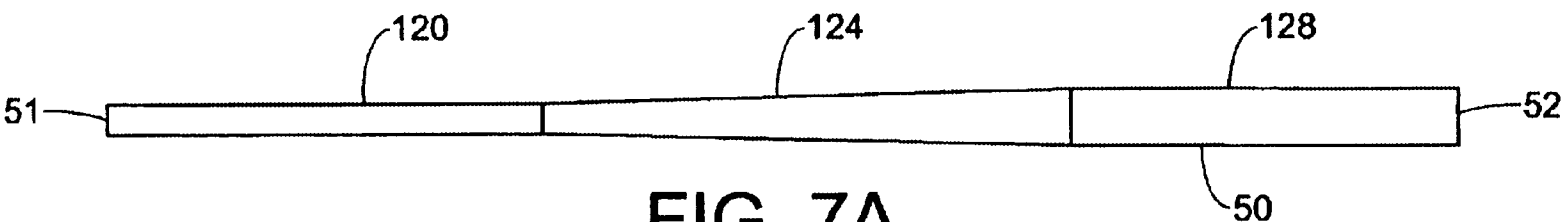

A "parallel-taper-parallel" composite shaft incorporating features of the present invention is composed of a series of sheets or flags of composite material laid-up on a mandrel 50 defining the inside diameter of the shaft as shown in FIG. 7A. The mandrel 50 includes a tip end 51 and a butt end 52. As shown more clearly in FIG. 7B, mandrel 50 comprises a cylindrical portion 120 from the tip end 51 to an intermediate point 122. A taper 124 proceeds from intermediate point 122 to the lowermost end 126 of cylindrical butt portion 128. In the illustrative embodiment of FIG. 5B, the diameter of mandrel 50 at the butt portion is a constant 0.460 inches.

Figure 6:
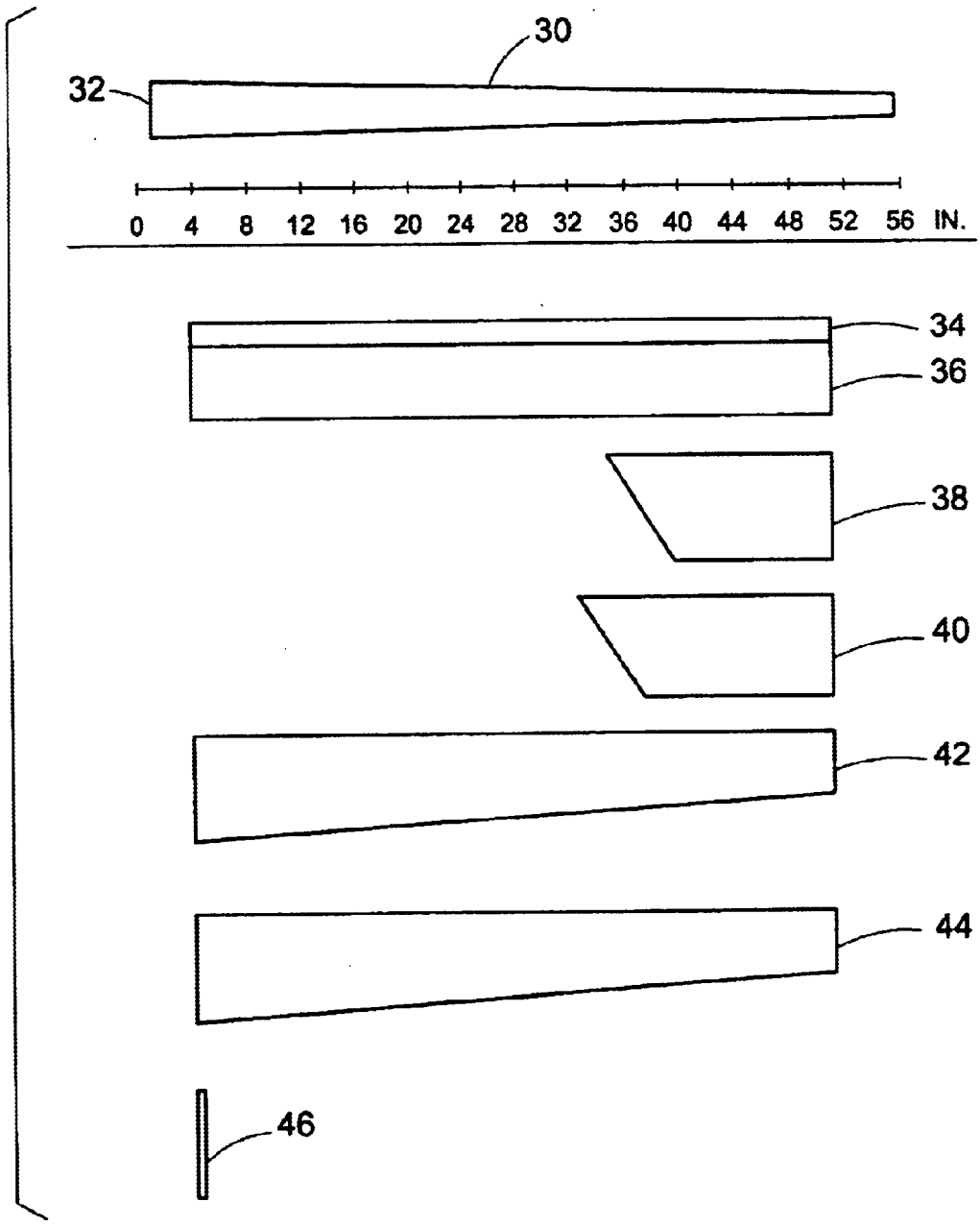
FIG. 6 illustrates a method of constructing a golf shaft in accordance with principles of the present invention.

Preferably the composite material used in construction the shaft comprises a nonwoven graphite fiber material suspended in a synthetic resin, such as a modified epoxy resin well known in the art. The composite material typically comprises about 30-35% resin by weight. As shown in FIG. 6, preferably, the innermost layers of material comprise two layers of graphite-epoxy 34, 36 extending the full length of the shaft. The composite material has an elastic modulus of 33 million psi and an ultimate tensile strength of about 500,000 psi, known in the industry as "33/500" graphite epoxy. The fibers of the inner two layers 34, 36 are oriented at angles of +45° and −45° respectively relative to the axis of the shaft so as to provide maximum resistance to torsion. The next two layers comprise tip insert flags, 38, 40, comprising two additional layers of 33/500 graphite epoxy extending approximately 10 inches from the tip. The fibers in the tip insert flags 38, 40 are oriented longitudinally along the axis of the shaft. The outer two layers 42, 44 comprise two fill-length flags of 33/500 graphite epoxy with fibers also oriented longitudinally along the axis of the shaft. A sacrificial flag 46 of 33/500 or other material may be included at the extreme butt end 32 of the shaft to assist in removing the shaft from the mandrel 32. The sacrificial flag 32 is removed as the finished shaft is trimmed to length.

Figure 8:
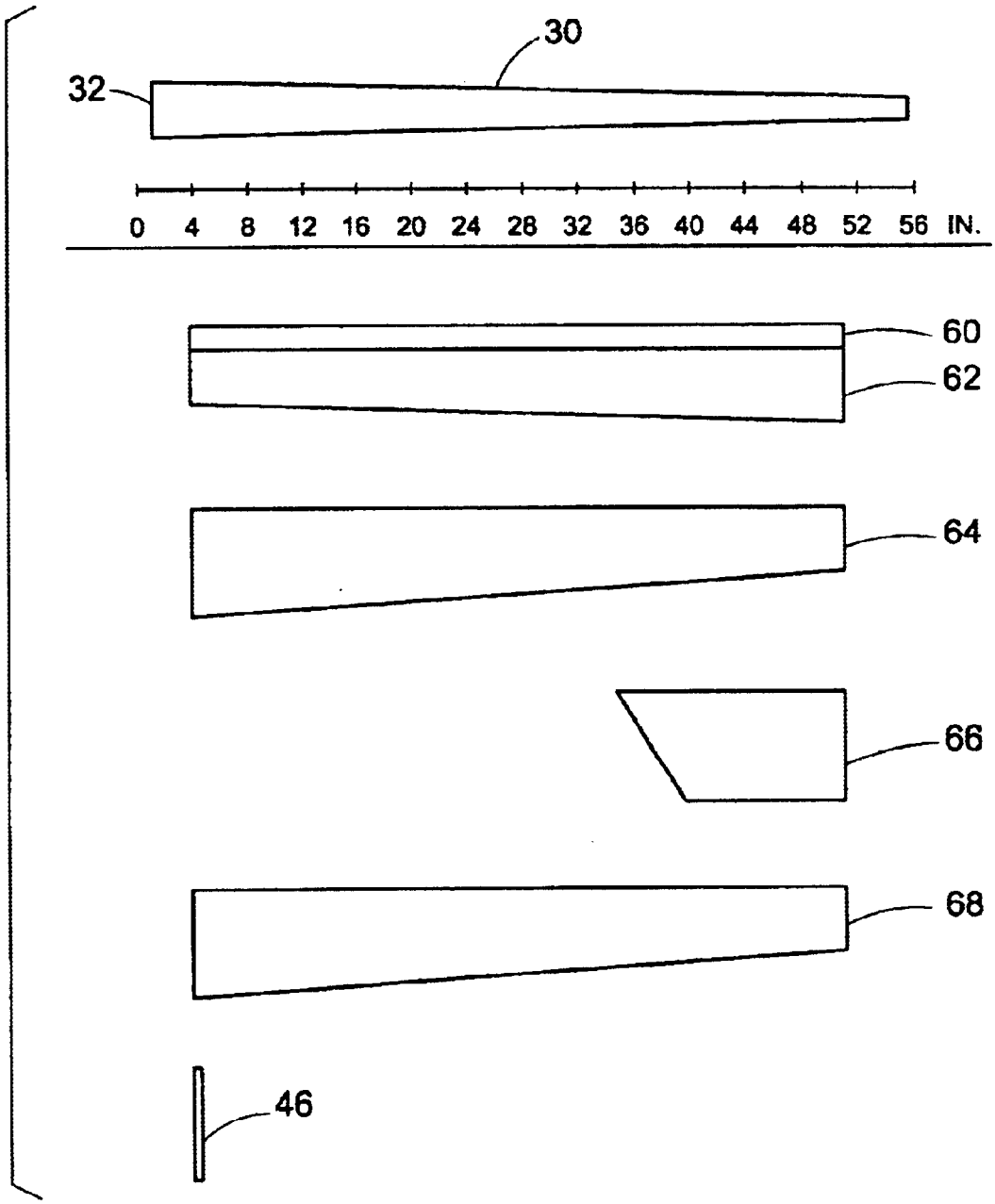
FIG. 8 illustrates a method of constructing a golf shaft in accordance with principles of the present invention.

An alternative embodiment as shown in FIG. 8 includes the innermost layers of material comprising two layers of a graphite epoxy material 60, 62 having an elastic modulus of 55 million psi and an ultimate tensile strength of approximately 700,000 psi, known in the industry as 50/700 graphite epoxy, extending the full length of the shaft with the fibers of the inner two layers oriented at angles of +45° and −45° respectively relative to the axis of the shaft. The next layer comprises a full length flag 64 of a the same 50/700 material, with the fibers of this layer oriented longitudinally along the axis of the shaft. The next layer comprises a tip insert layer 66 of 33/500 graphite epoxy extending approximately 20 inches from the tip. The fibers in the tip insert flags are also oriented longitudinally along the axis of the shaft. The outer layer then comprises a full-length flag 68 of 33/500 graphite epoxy with fibers also oriented longitudinally along the axis of the shaft. As with the embodiment of FIG. 6, sacrificial flag 46 of 33/500 or other material may be included at the extreme butt end of the shaft to assist in removing the shaft from the mandrel. The sacrificial layer is removed as the finished shaft is trimmed to length.

Figure 9A:
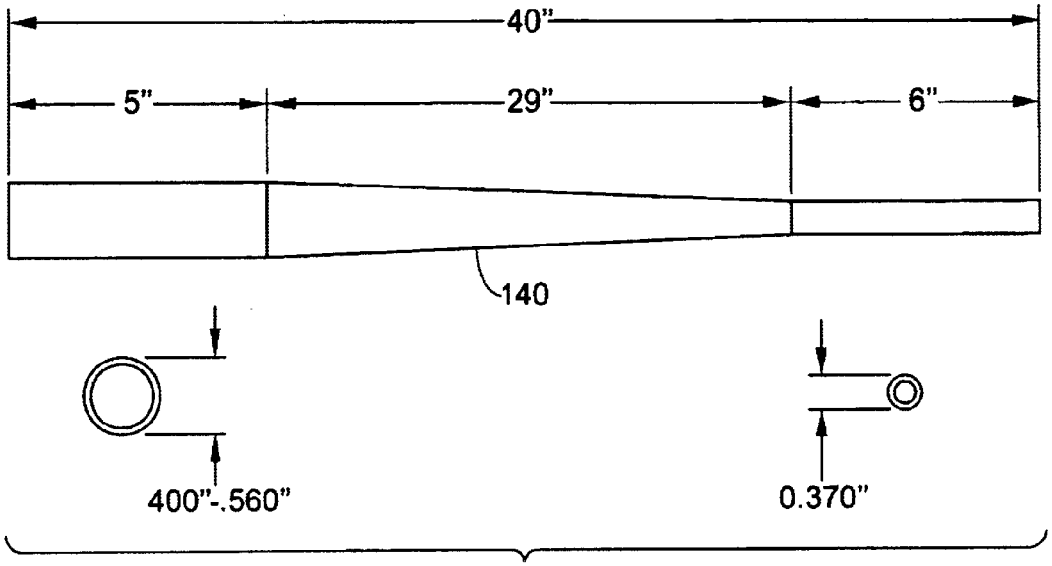
FIGS. 9A and 9B show illustrative embodiments of golf shafts constructed in accordance with principles of the present invention.
Figure 9B:
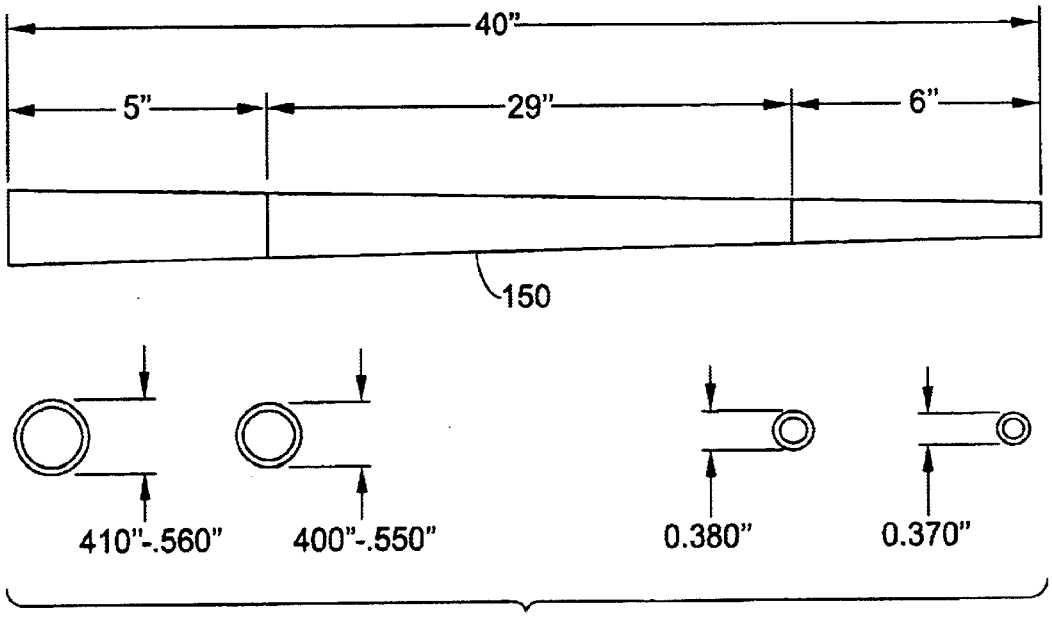

As shown in FIGS. 9A and 9B, the finished shafts 140, 150 have a standard nominal tip diameter of 0.370 inches, or 0.335–0.400 inch in diameter for woods and 0.330–0.390 inch in diameter for irons. The tip portion extends about 1 to 6 inches in length from the tip of the shaft. The shaft then tapers to the maximum outside diameter at the butt end of from 0.400–0.560 inches in diameter, preferably from 0.450 to 0.550 and most preferably from 0.520 to 0.540 inches in diameter. Shafts having a butt diameter significantly greater than 0.560 inch do not exhibit a significant degree of overall flex improvement over prior art shafts; and shafts having a butt diameter significantly below 0.400 are prone to breakage.

Special grips molded to standard outside contours but having a smaller inside diameter to conform to the reduced diameter butt are fitted to the finished shaft. Preferably the grips are molded of synthetic foam rubber or other suitable cushioning material. The inherently thicker wall of the special grips provides additional shock isolation to the user, thereby further increasing comfort and feel of the golf shaft. The total finished length of the shaft is typically from 35–47 inches overall. A standard club head may be fitted to the shaft to complete the golf club assembly.

As can be ascertained from the foregoing, because the shaft is constructed with a relatively conventional number of graphite epoxy layers, the resultant shaft has a wall thickness that is within normal tolerances of shafts of similar construction, however, because of the reduced inside diameter of the mandrel 30 or 50, the resulting outside diameter is reduced from an industry standard of 0.600–0.620 to the above referenced 0.400–0.560 inch. As is well known, the cross sectional moment of inertia of a round section is equal to the fourth power of the diameter. Accordingly, even the minimal reduction of the cross section from the minimum prior art diameter of 0.600 to the preferred diameter of 0.520–0.540 inch results in a 30% decrease in the cross sectional moment of inertia of the shaft and a corresponding increase in the shaft flexure. More moderate increases in flexure may be accomplished by reducing the outside diameter less dramatically, for example to 0.560 inches. Conversely, shafts constructed according to the present invention with smaller mandrels and smaller finished diameters exhibit even more dramatic increases in flexure.

Figure 10:
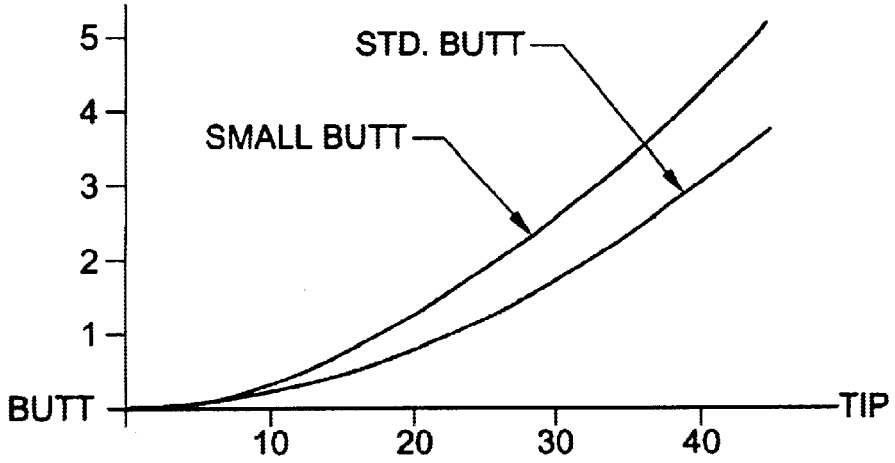
FIG. 10 is a graphical representation of the flex of a shaft constructed in accordance with principles of the present invention.
Figure 11:
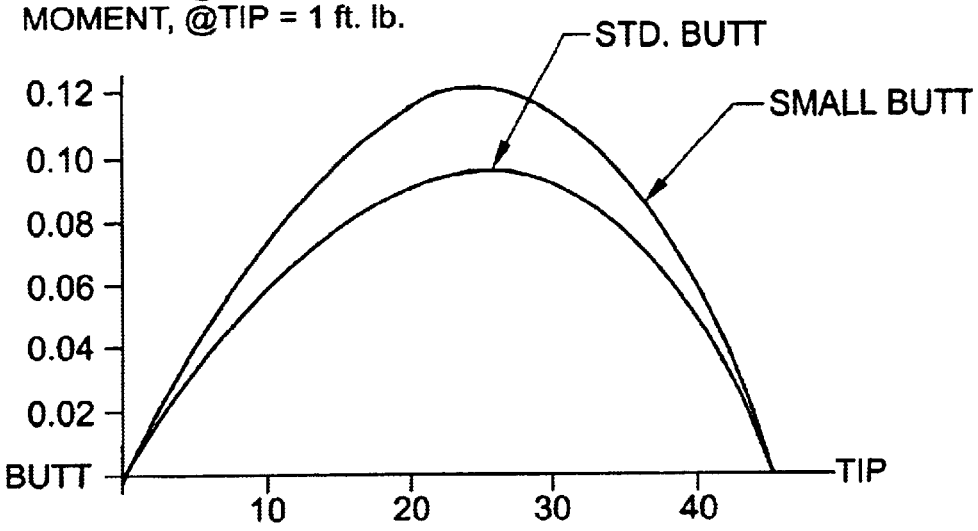
FIG. 11 is a graphical representation of the kick point of a shaft constructed in accordance with principles of the present invention.

As shown in FIG. 10, in a standard cantilever test, a composite shaft constructed according to the foregoing description having a butt outside diameter of 0.540 inches deflects over 1.5 inches more than a similarly constructed shaft having a butt outside diameter of 0.620 inches. More dramatic, however, is the shift in flex/kick point. As shown in FIG. 11, as a result of the reduced diameter butt configuration of the shaft, the shaft constructed in accordance with the principals of the present invention has a kick point that is over 3 inches nearer the butt end of the shaft than the similarly constructed shaft having a butt outside diameter of 0.620 inches.

The higher flex/kick point of the reduced diameter butt design of the present invention results in an increase in the desirable lead-lag bending without losing the ability to return the club face to square at impact. The increased flexibility in the butt portion of the shaft permits the user to better control the bend, part of which is occurring at the user's hands. Moreover, the increased lead-lag bending is accomplished without the high torque associated with soft shafts and without artificial discontinuities and impedance mismatching, which induces additional modes of vibration in bubble shafts and other similar designs.

Although certain preferred embodiments and methods have been disclosed herein, it will be apparent from the foregoing disclosure to those skilled in the art that variations and modifications of such embodiments and methods may be made without departing from the true spirit and scope of the invention. For example, although the illustrative embodiments comprise lay-ups of graphite epoxy flags, a shaft comprising a filament wound composite material, such as that described in ENGINEERED MATERIALS HANDBOOK VOL I (COMPOSITES) © 1987 ASM International, at pp. 503–07 (incorporated herein by reference) would be within the scope of the present invention. Accordingly, it is intended that the invention shall be limited only to the extent required by the appended claims and the rules and principles of applicable law.

What is claimed is:

1. A golf club shaft comprising:

an elongated tubular shaft comprising a plurality of layers of fibers imbedded in a synthetic resin, said elongated tubular shaft having a butt end of relatively larger cross sectional diameter tapering without intervening discontinuities to a tip end of relatively smaller diameter, said tip end having an outside diameter between 0.330 and 0.400 inches;

said butt end having an outside diameter of 0.400 to 0.540 inches.

2. The golf club shaft of claim 1, wherein:

said butt end has a wall thickness of between 0.04 and 0.045 inches.

3. The golf club shaft of claim 1, wherein:

a length of the shaft is from about 35–47 inches.

4. The composite golf club shaft of claim 1, further comprising:

two inner layers of graphite fibers embedded in epoxy, said inner layers having fibers oriented at angles of +45° and −45° respectively relative to the axis of the shaft.

5. The composite of golf club shaft of claim 1, further comprising:

an intermediate layer of graphite fibers embedded in epoxy, said graphite fibers being oriented longitudinal to the axis of the shaft.

6. A composite golf club shaft comprising:

an elongated tubular shaft comprising a plurality of layers of fiber embedded in a synthetic resin, said elongated tubular shaft having a butt section comprising a substantially cylindrical cross section of relatively larger cross section, which transitions without intervening discontinuities to a tapered intermediate section, said tapered intermediate section tapering without intervening discontinuities to a relatively smaller diameter tip section; said tip section including a portion having an outside diameter of between 0.330 and 0.400 inches;

said butt section having an outside diameter between 0.400 to 0.540 inches, said butt section diameter displacing a kick point above a center point of the composite golf club shaft.

7. The golf club shaft of claim 6, wherein:

said butt section has a wall thickness between 0.04 and 0.045 inches.

8. The golf club shaft of claim 6, wherein:

the golf club shaft has a length between 35 and 47 inches.

9. The composite golf club shaft of claim 6, further comprising:

two inner layers of graphite fibers imbedded in epoxy, said inner layers having fibers oriented at angles of +45° and −45° respectively relative to the axis of the shaft.

10. The composite golf club shaft of claim 6, further comprising:

an intermediate layer of graphite fibers embedded in epoxy, said graphite fibers being oriented longitudinal to the axis of the shaft.

11. A golf club shaft comprising:

an elongated tubular shaft, said elongated tubular shaft having a butt section comprising a substantially cylindrical cross section having an outside diameter of between 0.400 and 0.560 inches, which transitions without intervening discontinuities to a tapered intermediate section, said tapered intermediate section transitioning without intervening discontinuities to a relatively smaller diameter tip section, said tip section having an outside diameter of between 0.330 and 0.400 inches, and said tapered intermediate section having a more significant taper than both said butt and tip sections.

12. The shaft of claim 11 wherein said tip section and said butt section include parallel sidewalls.

13. A golf club shaft comprising:

an elongated tubular shaft having a length of between about 35 and 47 inches, said elongated tubular shaft having a butt section of relatively larger cross sectional diameter tapering without intervening discontinuities to a tip section of relatively smaller diameter, said tip section having an outside diameter between 0.330 and 0.400 inches;

said butt section having at least one portion with an outside diameter of between 0.400 and 0.540 inches, said butt section diameter displacing a kick point toward the butt end of the shaft.

* * * * *